United States Patent [19]

Blore

[11] 4,209,881

[45] Jul. 1, 1980

[54] KNITTING INTERMITTENTLY DRAWN YARNS

[75] Inventor: James H. Blore, Greenville, S.C.

[73] Assignee: Phillips Petroleum Company, Bartlesville, Okla.

[21] Appl. No.: 888,727

[22] Filed: Mar. 21, 1978

[51] Int. Cl.[2] ..... D02J 1/06; D04B 15/44

[52] U.S. Cl. ..... 28/243; 28/218; 66/146; 242/150 R

[58] Field of Search ..... 66/54, 132 R, 132 T, 66/146; 28/252, 218, 243; 242/150 R

[56] References Cited

U.S. PATENT DOCUMENTS

| | | | |
|---|---|---|---|
| 1,178,954 | 4/1916 | Schweiter | 242/150 |
| 2,128,033 | 8/1938 | Zonis | 242/150 X |
| 2,438,034 | 3/1948 | Brügger | 242/150 |
| 2,646,943 | 7/1953 | Lindsay | 242/150 |
| 3,206,138 | 9/1965 | Lindsay | 66/146 X |
| 3,435,636 | 4/1969 | Lindner et al. | 66/57 |
| 3,609,835 | 10/1971 | Boon | 28/252 X |
| 3,878,697 | 4/1975 | Tsunekawa | 66/146 |
| 3,922,887 | 12/1975 | Mishcon | 66/132 T |

FOREIGN PATENT DOCUMENTS

| | | | |
|---|---|---|---|
| 863981 | 1/1953 | Fed. Rep. of Germany | 66/146 |
| 902852 | 8/1962 | United Kingdom | 66/54 |
| 1123689 | 8/1968 | United Kingdom . | |

*Primary Examiner*—Wm. C. Reynolds

[57] ABSTRACT

A device for intermittently tensioning a yarn passing therethrough in which a motor cam acts on a tension train mounted on a fixed shaft. The tension train is composed of a tension adjuster which provides tension on a base plate, spring, and tension discs mounted between a stop and the tension adjuster. In an embodiment of the invention a method for intermittently tensioning a yarn by passing the yarn between the tension discs of the device described above.

3 Claims, 3 Drawing Figures

KNITTING INTERMITTENTLY DRAWN YARNS

BACKGROUND OF THE INVENTION

Figure 1:
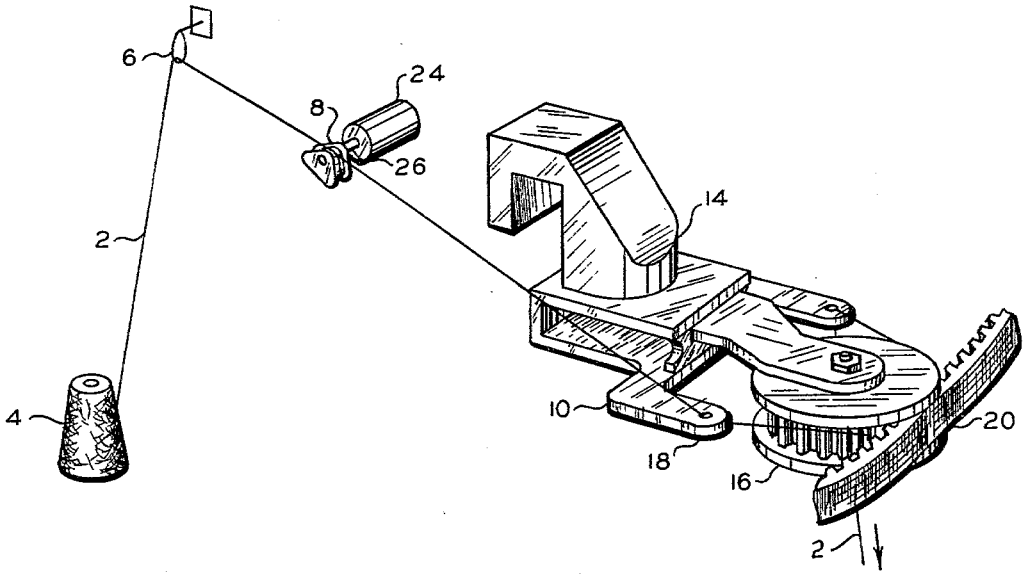

This invention relates to textured yarn. In one of its aspects this invention relates to the texturing of partially oriented yarn. In another of its aspects this invention relates to knitting machines having a positive feed mechanism that assures the yarn is fed to the needle cylinder a positive rate without slippage. In another of its aspects this invention relates to yarn that is intermittently stretched into thick and thin portions. In yet another of its aspects this invention relates to fabrics knitted from intermittently drawn partially oriented yarns. In yet another of its aspects this invention relates to textured yarns produced by deknitting fabrics produced by knitting thick-thin yarns. In yet another of its aspects this invention relates to novel dye effects produced with this yarn.

The present invention partially oriented yarn is knitted on a knitting machine that has a positive feed. Knitting machines that feed the yarn into the needle cylinder at a positive rate without slippage are well-known in the art. The art provides apparatus and method in which a plurality of yarn packages supply yarn through a combination of guides, tension devices, and a positive feeding device to a knitting machine. One form of this device is disclosed in U.S. Pat. No. 3,922,887 in which a plurality of toothed wheels, each of which is rotatable on a shaft, is driven by a matching toothed belt from a power unit so that the toothed wheels all travel at the same speed, feeding the yarns to the machine.

In the instant invention partially oriented yarn is fed through a positive feed device into a knitting machine. This partially oriented yarn, which will hereinafter be referred to as POY yarn, is a yarn which has been partially drawn during the melt spinning step, a yarn which needs a small additional drawing step to bring the yarn to its proper strength and usefulness. Whereas conventional yarns are melt spun and taken up at slow speeds without being oriented and are then drawn from about 2 to about 5 times their original length in one or two steps to obtain desired strength and usefulness, partially oriented yarns leave the spinneret in a vertical direction and are quenched by air while traveling for great distances at take up speeds of from about 1800 to about 3200 meters per minute. Yarn taken up at this speed is partially oriented and requires only a small additional drawing of about 1 to 2 times. The additional orienting is usually accomplished simultaneously with another operation such as false twist texturing.

It has now been discovered that using partially oriented yarns with a positive feed to a knitting machine, the introduction of an intermittend drawing or stretching opertion between the yarn package, and positive take up on the knitting machine produce novel knitted products.

It is, therefore, an object of this invention to provide method and apparatus for the intermittent tensioning of partially oriented yarn. It is another object of this invention to provide method and apparatus for producing intermittently drawn yarn for use in a knitting machine. It is still another object of this invention to provide a fabric and method for producing a textured fabric knitted of thick and thin yarn. It is yet another object of this invention to provide a method for producing a textured yarn by heat setting a fabric knitted from yarn intermittently drawn while being supplied to a positive feed device of a knitting machine with subsequent deknitting of the fabric.

Other aspects, objects, and the various advantages of this invention will become apparent upon the reading and study of this disclosure, the drawings, and the appended claims.

Statement of the Invention

According to this invention, an apparatus is provided for producing intermittently drawn yarn for knitting machine feed. In this apparatus, there are means for supplying yarn from a yarn package to a positive feed device supplying yarn to the needle cylinder of a knitting machine with a means for applying variable tension to the yarn positioned between the yarn package and the positive feed device.

In an embodiment of the invention, a method is provided for producing intermittently drawn yarn for feeding and knitting machines. In this method partially oriented year is supplied from a yarn package with the application of intermittent tension to the yarn while it is being taken up into a positive feed device supplying the needle cylinder of a knitting machine.

The use of any means for intermittently tensioning the partially oriented yarn as it passes to the positive feed for the needle cylinder of a knitting machine is contemplated by this invention. Such well-known means as a non-circular cam, i.e., oval, triangular, square, diamond-shape, is considered particularly useful for supplying intermittent tension to a yarn strand. The cam can be driven at a predetermined speed either at a uniform speed, a uniformly cycling speed, or a totally irregular speed.

According to an embodiment of this invention, a particular means for intermittently tensioning a yarn passing therethrough is provided. This device is a fixed shaft with a tension train mounted on the shaft. The tension train consists of a stop plate fixed to the shaft; a base plate pierced by the fixed shaft, but not attached thereto, with a lever arm extending from the base plate; a helical spring surrounding the fixed shaft, but not attached thereto; a pair of tension discs pierced by the fixed shaft, but not attached thereto; and an adjusting means movably attached to the fixed shaft to provide tension on the base plate, spring, and tension discs mounted between the stop ad the adjusting means. A motor driven cam is aligned with the fixed shaft to act on the lever arm thereby varying the tension on the tension train by varying the pressure on one side of the spring. The cam can be any shape other than circular and can be driven at a predetermined, constant or variable speed.

A method is also provided for the intermittent tensioning of yarn in which a yarn drawn by a positive feed means is drawn between the tensioning discs of the apparatus described above.

Yarn drawn by a positive feed mechanism into a knitting machine after having been intermittently drawn or stretched by the apparatus and method described above has thick and thin portions that when knitted produces a fabric that upon dyeing has a varied coloration. The variation in color is produced because the drawn portions of the yarn are superior in taking up dye as compared to the undrawn portions of the yarn. Since a plurality of yarns is fed into a knitting machine, the treatment of one or more yarns used in the apparatus and method above can give a novelty effect to the produced fabric. After dyeing and heat setting, the fabric can be deknitted to produce a textured yarn which can then be used to make any other type of fabric. The deknitting yarn will retain the novel dye effect even upon bulking. A knit-deknit method for texturing the yarn is well-known in the art, but used in conjunction with the apparatus and process described above can produce yarns having a unique dye effect.

Figure 2:
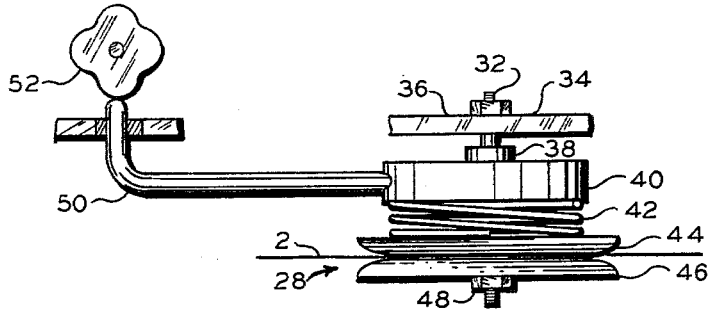
Figure 3:
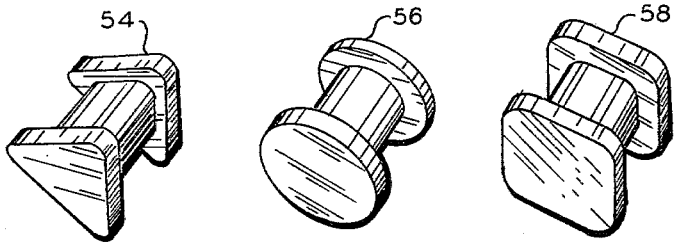

The invention can be best understood in conjunction with the drawings in which:

FIG.1 shows the string up from the yarn package through an intermittent tensioning device and a positive feed device directing yarn to the needle cylinder of a knitting machine, FIG. 2 describes an intermittent tensioning device of the present invention, and FIG. 3 shows various cam shapes suitable for use in the apparatus of FIG. 1 or FIG. 2.

Referring now FIG. 1, a strand of yarn 2 is fed from a yarn package 4 through a guide 6 and across a non-circular cam 8 to a positive feed device 10 such as described in U.S. Pat. No. 3,922,887 from which it is fed to the needle cylinder of a knitting machine (not shown). A typical positive feed device comprises a shaft 12 attached to a fixed support 14 with a toothed wheel 16 attached to the shaft 12 so that the yarn 2 is passed through guide 18 and between toothed wheel 16 and toothed belt 20 to guide 22 and thence to the knitting machine. The particular type of positive feed device does not form a part of this invention which resides in the combination of the positive feed device with an intermittent tensioning or stretching device. In FIG. 1 the intermittent tensioning device is a cam 8 attached to a drive motor 24 by shaft 26. The cam can be of any shape that imparts an irregular tensioning to the yarn wrapped around it. Another variation in the spacing of the stretched portions of yarn and in the degree of tensioning can be achieved by using a variable drive motor to rotate the cam 8. The motor drive can be programmed to vary its speed in a set pattern or the speed can be randomly varied.

In FIG. 2, a specific intermittent tensioning device 28 is described which can be substituted in the string up shown in FIG. 1 for the cam 8. In this device 28 what has been described as a "tension train" 30 is mounted on a fixed shaft 32. The fixed shaft 32 can be firmly mounted on a support 34 as by being screwed into a nut 36 welded to the support. The tension train is made up of a stop plate 38 fixed to the shaft. This plate can be as simple as a nut welded on the fixed shaft. Next to the stop plate is positioned a base plate 40 which is pierced by the fixed shaft 32 but is not fixedly attached thereto. Adjacent to the base plate, a helical spring 42 encircles the fixed shaft 32 which retains the spring in place between the base plate and a pair of tension discs 44, 46 which are also pierced by the fixed shaft 32 but not fixed thereto. An adjusting means 48 which can be a nut that is moved on a threaded end of the fixed shaft 32 retains the tension train 30 in place on the fixed shaft 32. The adjusting means can be tightened or loosened to provide tension on the tension train 30 by compressing the spring 42. The tension is adjusted to provide sufficient room for passage of yarn 2 between the tension discs 44, 46 without stretching of the yarn.

The base plate 40 has a lever arm 50 attached thereto which extends away from the tension train 30 and is aligned with a motor driven cam 52 so that the movement of the cam causes movement of the lever arm 50 which rocks the base plate 40 thereby compressing one side of the spring 42. The stop plate 38 acts as a fulcrum for the lever action of arm 50 on the base plate 40. The base plate 40 fits loosely around the shaft 32 permitting the rocking of the plate and the compression of one side of spring 42. The compression of the spring 42 causes pressure on the yarn 2 passing between tension discs 44, 46 which stretches the yarn while compression is applied. The movement of the cam alternately applies and removes pressure on spring 42 to provide alternate stretching of the yarn 2. The motor drive (not shown) for the cam 52 can be a constant or variable speed drive.

FIG. 3 shows various shaped cams: triangular-shaped 54, oval-shaped 56, and square-shaped 58. Cams of these shapes and others are alternative designs for the cam in FIG. 1 and FIG. 2 It should be noted that the cam 52 is illustrated as having lobes which would be operative for changing the tension on the disc-type variable tension device illustrated in FIG. 2 and which would probably act similarly to the square-shaped cam 58 in operation in the apparatus illustrated in FIG. 1.

I claim:

1. A device for intermittently tensioning a yarn that is passed therethrough comprising:
   (1) a fixed shaft;
   (2) a tension train mounted on said shaft so that each element of the train encircles the shaft said train comprising elements arranged in the order of:
      (a) a stop,
      (b) a base plate,
      (c) a helical spring,
      (d) a pair of tension discs, and
      (e) an adjusting means to provide tension on the base plate, spring, and tension discs mounted between the stop and the adjusting means, said adjusting means set to provide sufficient clearance between said tension discs to permit passage of yarn therebetween without stretching said yarn;
   (3) a lever arm attached to said base plate, and
   (4) a motor driven cam aligned to act on said lever arm intermittently to apply sufficient pressure to one side of said spring to cause sufficient pressure on yarn that is passed between said tension discs to stretch said yarn while the pressure is applied.

2. A device of claim 1 wherein said cam is driven by a variable speed motor.

3. A method for intermittently tensioning a yarn comprising passing a yarn drawn by a positive feed device between the tension discs of the device of claim 1 while driving said cam at a predetermined speed thereby varying tension on said device.

* * * * *